US011560286B2

(12) United States Patent
Murata et al.

(10) Patent No.: US 11,560,286 B2
(45) Date of Patent: Jan. 24, 2023

(54) SHEET FOLDING DEVICE AND SHEET POST-PROCESSING APPARATUS INCLUDING THE SAME

(71) Applicant: KYOCERA Document Solutions Inc., Osaka (JP)

(72) Inventors: Koji Murata, Osaka (JP); Tadahisa Kishimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/477,096

(22) Filed: Sep. 16, 2021

(65) Prior Publication Data

US 2022/0089402 A1 Mar. 24, 2022

(30) Foreign Application Priority Data

Sep. 18, 2020 (JP) ..... JP2020-157040

(51) Int. Cl.

| | |
|---|---|
| ***B65H 45/16*** | (2006.01) |
| ***B65H 37/06*** | (2006.01) |
| ***B65H 45/18*** | (2006.01) |
| ***B65H 29/58*** | (2006.01) |
| ***B65H 45/30*** | (2006.01) |

(52) U.S. Cl.

CPC ..... *B65H 37/06* (2013.01); *B65H 29/58* (2013.01); *B65H 45/18* (2013.01); *B65H 45/30* (2013.01); *B65H 2301/45* (2013.01); *B65H 2404/14* (2013.01)

(58) Field of Classification Search

CPC .... B65H 2301/45; B65H 45/16; B65H 45/18; B65H 45/20; B65H 37/06

USPC ..... 493/444

See application file for complete search history.

(56) References Cited

U.S. PATENT DOCUMENTS

| | | | | |
|---|---|---|---|---|
| 4,985,013 | A * | 1/1991 | van der Werff | B65H 45/18 493/437 |
| 6,565,076 | B2 * | 5/2003 | Kubota | B65H 45/18 227/4 |
| 6,881,181 | B2 * | 4/2005 | Brown | B65H 45/18 493/419 |
| 8,257,238 | B2 * | 9/2012 | Eijkelkamp | B65H 45/18 493/434 |
| 10,599,088 | B2 * | 3/2020 | Matsuno | B65H 29/52 |

(Continued)

FOREIGN PATENT DOCUMENTS

JP 2017-132572 A 8/2017

*Primary Examiner* — Leslie A Nicholson, III

(74) *Attorney, Agent, or Firm* — Studebaker & Brackett PC

(57) ABSTRACT

A sheet folding device includes a folding rollers pair, a folding blade and a sheet guide. The folding rollers pair causes a sheet to pass through a first nip area to fold the sheet. The folding blade includes a blade portion and a pair of arm portions. The blade portion is selectively disposed in a folding position where the blade portion pushes a folded portion of the sheet into the first nip area and in a retracting position where the blade portion is retracted from the folding position. The pair of arm portions couples both end portions of the blade portion with the pivot shaft. The sheet guide can be passed between the pair of arm portions. Between the blade portion and the sheet guide, a retreating path in which a part of the sheet is retreated when the folded portion is pushed into the first nip area.

8 Claims, 10 Drawing Sheets

(56) References Cited

U.S. PATENT DOCUMENTS

| | | | | |
|---|---|---|---|---|
| 11,225,391 | B2 * | 1/2022 | Fukasawa | B65H 45/18 |
| 2010/0133736 | A1 * | 6/2010 | Park | B65H 45/18<br>270/32 |

* cited by examiner

SHEET FOLDING DEVICE AND SHEET POST-PROCESSING APPARATUS INCLUDING THE SAME

INCORPORATION BY REFERENCE

This application is based on and claims the benefit of priority from Japanese patent application No. 2020-157040 filed on Sep. 18, 2020, which is incorporated by reference in its entirety.

BACKGROUND

The present disclosure relates to a sheet folding device performing a folding processing on a sheet, such as a paper sheet, on which an image is formed by an image forming apparatus, such as a copying machine and a printer, and a sheet post-processing apparatus including the sheet folding device.

A sheet post-processing apparatus provided with a sheet folding device which performs a folding processing on a paper sheet (a sheet) on which an image is formed by an image forming apparatus, such as a copying machine and a printer, is conventionally used.

The sheet folding device provided with a folding rollers pair consisting of two folding rollers and a folding blade capable of advancing to and retreating from a nip area between the folding rollers is known. In the sheet folding device, a predetermined portion of the sheet is bent by the folding blade and then pushed into the nip area of the folding rollers. Then, the sheet is pressed at the nip area of the folding rollers, thereby performing a folding processing on the sheet.

For example, the folding blade is pushed into the nip area from a direction opposite to the folding rollers in a state where the center of the sheet is positioned to the nip area when the paper is folded in two and in a state where the ⅓ portion of the sheet is positioned to the nip area when the sheet is folded in three.

As a method for pushing the folding blade, there are a method for reciprocating the folding blade to the sheet and pushing the sheet and a method for rotationally driving the folding blade and pushing the sheet. The method for rotationally rotating the folding blade makes the number of member small and the structure simple.

For example, in a method for folding the sheet using a fixing rollers pair, an image forming apparatus is provided, which includes a first conveyance path for guiding the sheet to the fixing rollers pair, a second conveyance path for guiding the sheet on which a toner image is fixed by the fixing rollers pair to the first conveyance path, a third conveyance which is branched from the first conveyance path between a second transfer area and the fixing rollers pair and guides the sheet to the second conveyance path, and a switching member for switching the sheet conveying destination to the fixing rollers pair or the third conveyance path.

When the sheet is folded, the switching member provided at a branch portion between the first conveyance path and the third conveyance path is rotated, and pushes a loop (a deflected portion) of the sheet into the nip area of the fixing rollers pair, as a folding blade.

However, when the folding blade is rotationally driven as described above, in order to push the folding blade from the side opposite to the folding direction, it is necessary to provide the turning fulcrum of the folding blade on the same side as the folding blade with respect to the sheet. That is, since the turning fulcrum of the folding blade is located on the side opposite to the folding rollers pair with respect to the sheet, it is difficult to make the turning locus of the folding blade perpendicular to the sheet when the sheet is pushed in. Therefore, there is a problem that the sheet cannot be accurately pushed into the nip area of the folding rollers. Further, since the mounting position of the folding blade is largely restricted in relation to the component configuration, it is impossible to make the folding blade large, and there is a problem that it is not possible to push in the sheet sufficiently.

SUMMARY

In accordance with an aspect of the present disclosure, a sheet folding device includes a folding rollers pair, a folding blade and a sheet guide. The folding rollers pair is configured to cause a sheet conveyed along a sheet conveyance path extending in a first conveyance direction to pass through a first nip area to fold the sheet in two and to convey the sheet in a first direction crossing to the first conveyance direction. The folding blade extends in an axial direction of the folding rollers pair, is disposed facing the folding rollers pair, and is configured to push a folded portion of the sheet into the first nip area. The sheet guide extends in the axial direction on an upstream side of the folding rollers pair in the first direction. The folding blade includes a pivot shaft, a blade portion and a pair of arm portions. The pivot shaft is provided parallel to the axial direction. The blade portion is pivotable around the pivot shaft, and is selectively disposed in a folding position where the blade portion pushes the folded portion of the sheet into the first nip area and in a retracting position where the blade portion is retracted from the folding position to an opposite side to the folding rollers pair with respect to the sheet conveyance path. The pair of arm portions couples both end portions of the blade portion in the axial direction with the pivot shaft. The sheet guide can be passed between the pair of arm portions. The blade portion faces the sheet guide in a state of being disposed in the retracting position, and forms, between the blade portion and the sheet guide, a retreating path in which a part of the sheet is retreated when the folded portion is pushed into the first nip area.

In accordance with an aspect of the present disclosure, a sheet post-processing apparatus includes a carry-in port into which a sheet is carried; the sheet folding apparatus configured to perform the folding processing on the sheet conveyed from the carry-in port; a discharge port through which the sheet is discharged; and a discharge tray configured to receive the sheet discharged through the discharge port is stacked.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Figure 1:
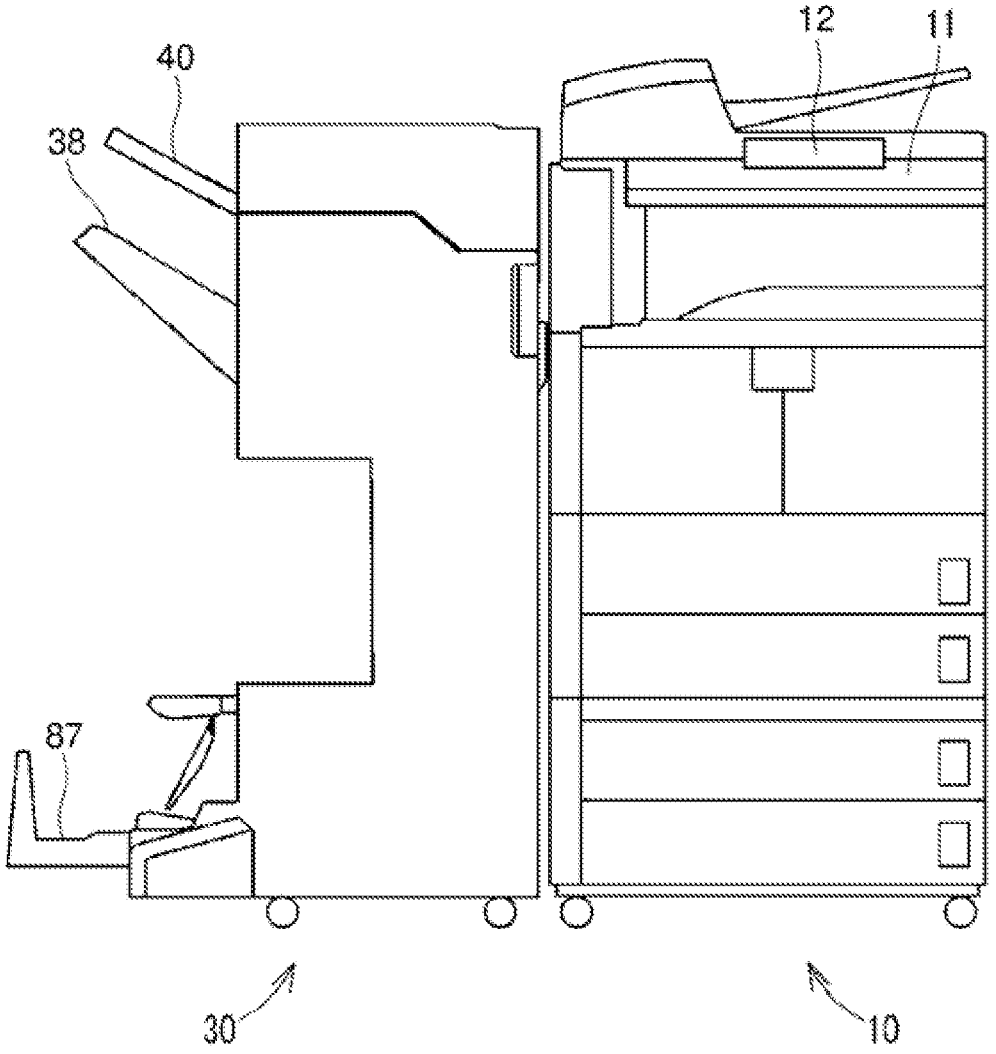
FIG. 1 is a view schematically showing a configuration of an image forming system consisting of a sheet post-processing apparatus 30 provided with a first sheet folding unit 60 according to one embodiment of the present disclosure and an image forming apparatus 10 to which the sheet post-processing apparatus 30 is connected.
Figure 2:
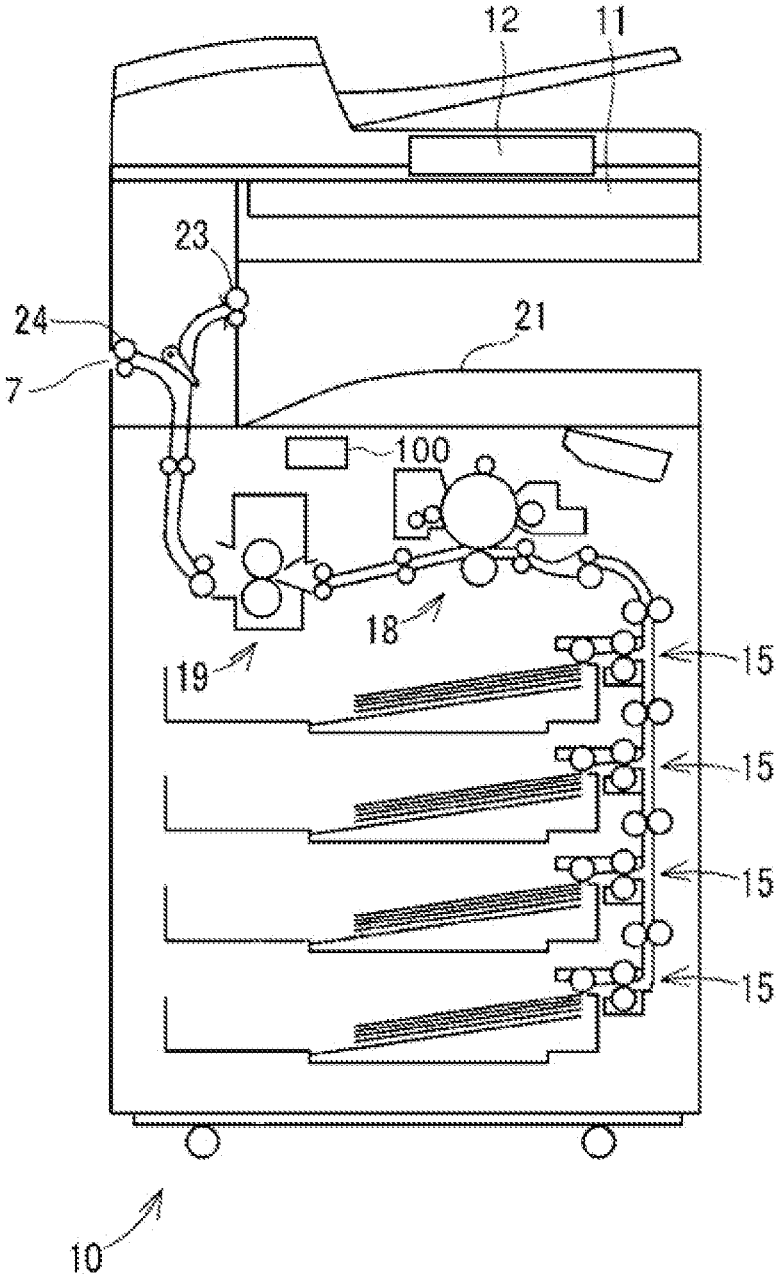
FIG. 2 is a side sectional view showing an inner structure of the image forming apparatus 10 to which the sheet post-processing apparatus 30 provided with the first sheet folding unit 60 of the present embodiment is connected.
Figure 3:
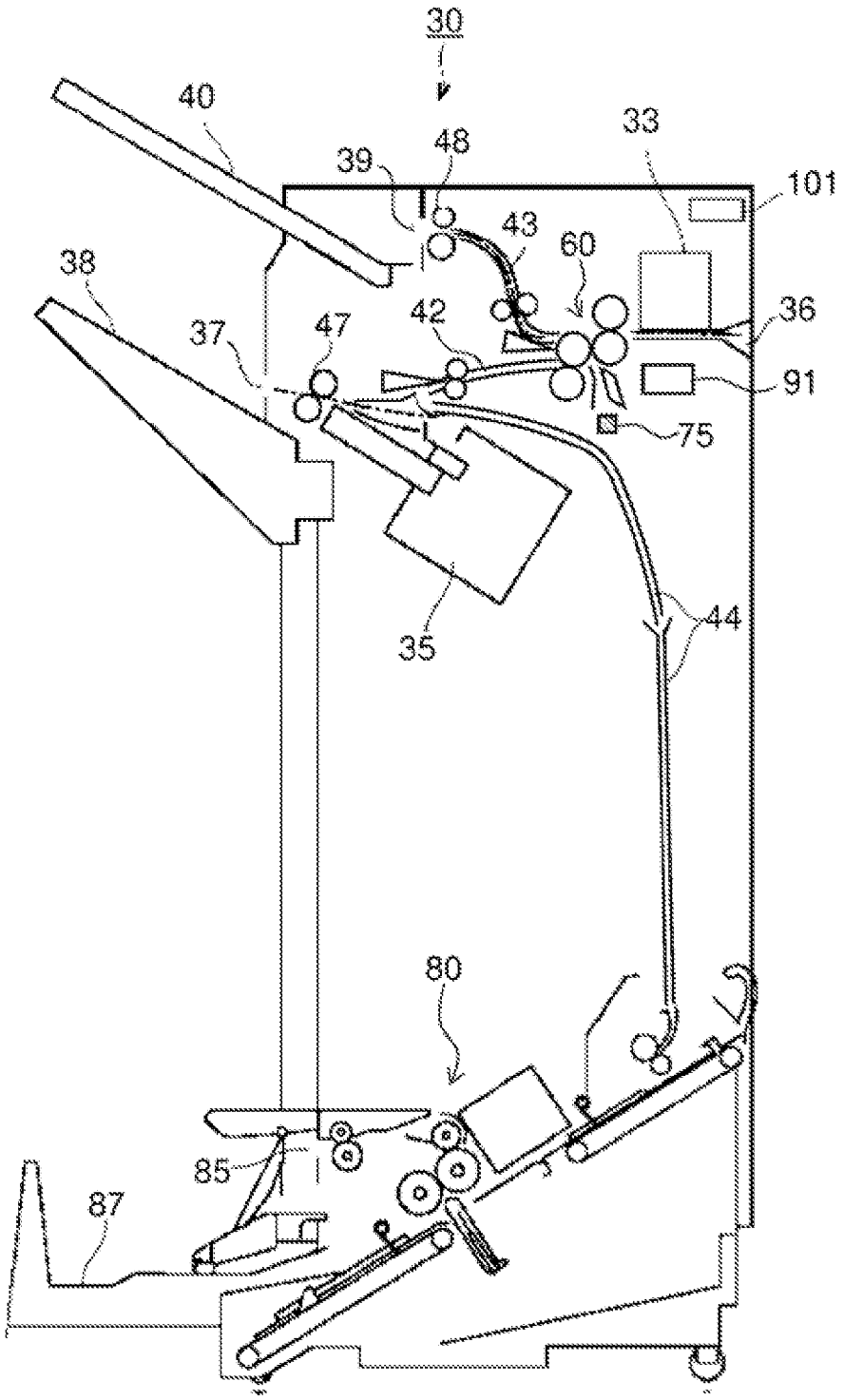
FIG. 3 is a side sectional view showing an inner structure of the sheet post-processing apparatus 30 provided with the first sheet folding unit 60 of the present embodiment.

Hereinafter, with reference to the attached drawings, an embodiment of the present disclosure will be described. FIG. 1 is a view schematically showing a configuration of an image forming system consisting of a sheet post-processing apparatus 30 provided with a first sheet folding unit 60 according to one embodiment of the present disclosure and an image forming apparatus 10 to which the sheet post-processing apparatus 30 is connected. FIG. 2 is a side sectional view showing an inner structure of the image forming apparatus 10 to which the sheet post-processing apparatus 30 provided with the first sheet folding unit 60 is connected. FIG. 3 is a side sectional view showing an inner structure of the sheet post-processing apparatus 30 provided with the first sheet folding unit 60.

As shown in FIG. 1, the image forming apparatus 10 prints an image on a paper sheet (a sheet) based on image data input from an external device through a network communication part (not shown) or image data read by an image reading part 11 disposed above the image forming apparatus 10. As shown in FIG. 2, the image forming apparatus 10 includes sheet feeding parts 15 which feed the sheet, an image forming part 18 which forms a toner image on the sheet, a fixing part 19 which fixes the toner image on the sheet, discharge rollers pairs 23 and 24 which convey the sheet on which the toner image is fixed to a sheet discharge part 21 and the sheet post-processing apparatus 30 respectively, and a main controller 100. The main controller 100 controls the operation of the image forming apparatus 10, and is configured to be communicated with a post-processing controller 101, described later, of the sheet post-processing apparatus 30 and controls the post-processing controller 101.

The sheet post-processing apparatus 30 is connected to the image forming apparatus 10, and performs a post-processing such as a punching processing, a binding processing and a folding processing, on the sheet conveyed from the image forming apparatus 10. The sheet post-processing apparatus 30 is not limited to that performing the post-processing on the sheet automatically conveyed from the image forming apparatus 10, and may perform the post-processing on the sheet which is placed on a tray (not shown) by a user and then naturally conveyed to a position where the post-processing can be performed.

As shown in FIG. 3, the sheet post-processing apparatus 30 includes a punching unit 33 which performs a predetermined punching processing on the sheet, a staple unit 35 which stacks a plurality of the sheets and then staples them with a staple, the first sheet folding unit 60 (an example of a sheet folding device) and a second folding unit 80 which perform a folding processing on the sheet. The sheet post-processing apparatus 30 further includes a sheet carry-in port 36 into which the sheet discharged through a discharge port 7 (see FIG. 2) of the image forming apparatus 10 is carried, a main discharge tray 38 on which the sheet discharged through a main discharge port 37 is stacked, a sub discharge tray 40 on which the sheet discharged through a sub discharge port 39 is stacked, the post-processing controller 101 which controls the sheet post-processing apparatus 30 integrally, and various switching members and various rollers.

The sheet carry-in port 36 and the main discharge port 37 are communicated with each other by a first conveyance path 42. A second conveyance path 43 branched and connected to the first conveyance path 42 is connected to the sub discharge port 39. A third conveyance path 44 branched and connected to the first conveyance path 42 is connected to the second sheet folding unit 80.

The sheet received through the sheet carry-in port 36 is fed to the downstream side (the left side in FIG. 3) along the first conveyance path 42. At the downstream end of the first conveyance path 42, a main discharge rollers pair 47 which feeds the sheet to the main discharge tray 38 is provided. The main discharge rollers pair 47 is configured such that the rollers are separated away each other to release the nip area between the rollers when the sheet is fed to the staple unit 35. The main discharge tray 38 mainly receives a sheet bundle to which the binding processing is performed by the staple unit 35. The main discharge tray 38 may receive the sheet on which the post-processing is not performed or the sheet on which only the punching processing is performed.

At the downstream end of the second conveyance path 43, a sub discharge rollers pair 48 which feeds the sheet to the sub discharge tray 40 is provided. The sub discharge tray 40 mainly receives the sheet discharged without being subjected to the post-processing by the post-processing apparatus 30, the sheet to which only to the punching processing is performed by the punching unit 33, and the sheet to which only the folding processing is performed by the first sheet folding unit 60.

The punching unit 33 is disposed between the sheet carry-in port 36 and the first sheet folding unit 60 above the first conveyance path 42. The punching unit 33 performs the punching processing on the sheet conveyed on the first conveyance path 42 at a predetermined timing.

The staple unit 35 is disposed below the downstream side portion of the first conveyance path 42. The staple unit 35 performs a stacking processing for stacking a plurality of the sheets to form a sheet bundle, and performs the binding processing for stapling the sheet bundle with a staple.

The first sheet folding unit 60 is disposed immediately upstream of a branching portion of the first conveyance path 42 and the second conveyance path 43. The first sheet folding unit 60 performs the folding processing on the sheet, for example, when the user selects the folding processing for one sheet. The detailed configuration of the first sheet folding unit 60 will be described later.

The second sheet folding unit 80 is disposed in the lower portion of the sheet post-processing apparatus 30 on the downstream side portion of the third conveyance path 44. The second sheet folding unit 80 performs the folding processing on the sheet bundle consisting of a plurality of the sheets, for example, when the user selects the folding processing on the sheet bundle. On the downstream side of the second sheet folding unit 80, a lower discharge port 85 through which the sheet bundle folded by the second sheet folding unit 80 is discharged and a lower discharge tray 87 on which the sheet bundle discharged through the lower discharge port 85 is received are provided.

Figure 4:
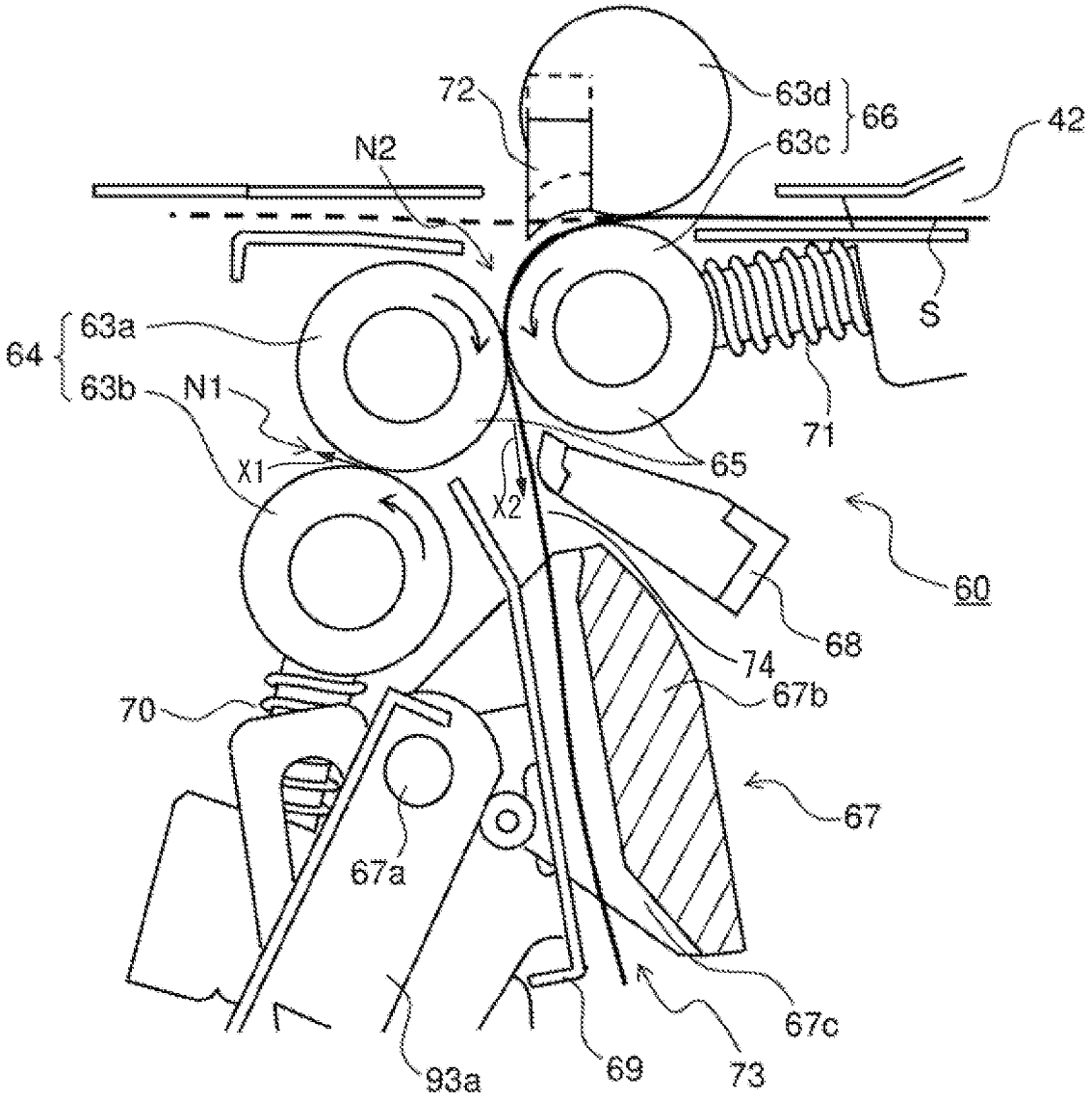
FIG. 4 is a sectional view showing a structure of the first sheet folding unit 60 of the present embodiment in a state where a folding blade 67 is disposed in a retracting position and a movable guide 69 is disposed in a covering position.
Figure 5:
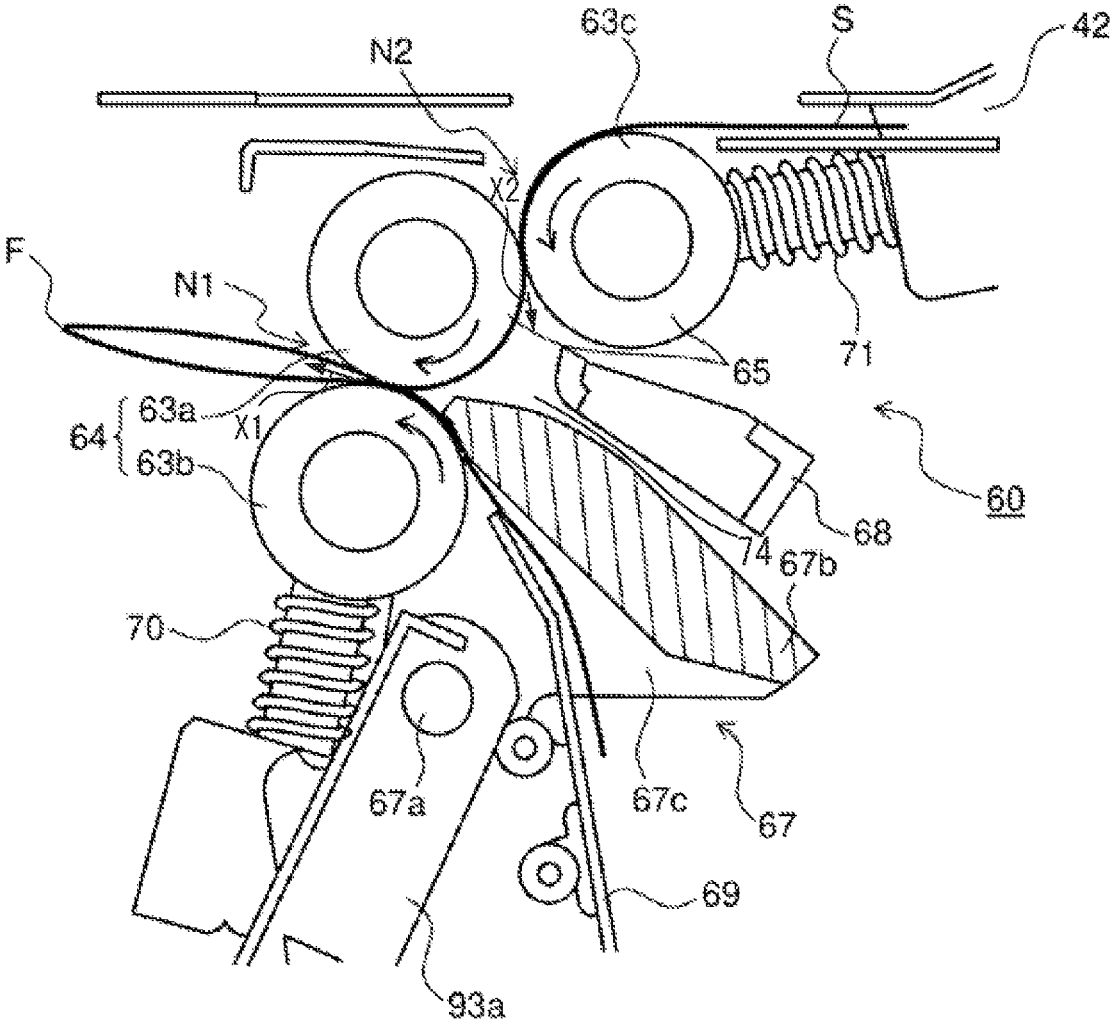
FIG. 5 is a view showing a state where the folding blade 67 is disposed in a folding position and the movable guide 69 is disposed in a non-covering position when a sheet S is folded in two by the first sheet folding unit 60.

FIG. 4 and FIG. 5 are partial enlarged views showing the first sheet folding unit 60 shown in FIG. 3. Hereinafter, the configuration of the first sheet folding unit 60 will be described in detail. As shown in FIG. 4, the first sheet folding unit 60 includes a folding rollers pair 64, a first conveyance rollers pair 65, a folding blade 67, a fixed guide 68, and a movable guide 69. The movable guide 69 is an example of a sheet guide of the present disclosure.

The folding rollers pair 64 consists of a first roller 63*a* and a second roller 63*b*. The second roller 63*b* is brought into pressure contact with the first roller 63*a* at a predetermined pressure by a first pressure contact mechanism 70 to form a first nip area N1. The sheet S passed through the first nip area N1 is conveyed from the right to the left (a first direction X1) in FIG. 4.

The first conveyance rollers pair 65 consists of the first roller 63*a* and a third roller 63*c*. The third roller 63*c* is brought into pressure contact with the first roller 63*a* at a predetermined pressure by a second pressure contact mechanism 71 to form a second nip area N2. The sheet S passed through the second nip area N2 is conveyed along a conveyance path 74 extending in a direction (a first conveyance direction X2) from the upper to the lower in FIG. 4, crossing to the first direction X1.

The second roller 63*b* is brought into pressure contact with the first roller 63*a* on the downstream side (the lower side in FIG. 4) of the conveyance direction (the first conveyance direction X2) of the sheet S by the first conveyance rollers pair 63. The rotational centers of the first roller 63*a*, the second roller 63*b*, and the third roller 63*c* are arranged so as not to be aligned on the same straight line. That is, they are brought into contact with each other such that the straight line connecting the rotational centers of the first roller 63*a* and the second roller 63*b* and the straight line connecting the rotational centers of the first roller 63*a* and the third roller 63*c* are crossed at a predetermined angle.

A fourth roller 63*d* is brought into pressure contact with the third roller 63*c* to constitute a second conveyance rollers pair 66. The fourth roller 63*d* consists of two roller parts divided in the axial direction (a direction perpendicular to the paper plane on which FIG. 4 is drawn), and is brought into pressure contact with both the axial end portions of the third roller 63*c*. A switching guide 72 is disposed between the two roller parts of the fourth rollers 63*d*. When the folding processing is not performed on the sheet S, the sheet S is horizontally conveyed along the first conveyance path 42 by retreating the switching guide 72 upward (to the position indicated by the broken line in FIG. 4), conveyed along the second conveyance path 43, and is discharged to the sub discharge tray 40 (both shown in FIG. 3).

The folding blade 67 has a pivot shaft 67*a*, a blade portion 67*b* and arm portions 67*c*. The pivot shaft 67*a* is provided on the same side (the left side in FIG. 4) as the folding rollers pair 64 with respect to the conveyance path 74 for the sheet S parallel to axes of the folding rollers pair 64, and is supported by a first frame 93*a* of the sheet post-processing apparatus 93 in a turnable manner. The blade portion 67*b* is disposed on the opposite side (the right side in FIG. 4) to the folding rollers pair 64 with respect to the conveyance path 74 for the sheet S. The arm portions 67*c* couple the axial end portions of the blade portion 67*b* to the pivot shaft 67*a*. The blade portion 67*b* is selectively disposed at a folding position (see FIG. 5) where the blade portion 67*b* pushes the sheet S into the second nip area N2 to perform the folding processing and at a retracting position (see FIG. 4) where the blade portion 67*b* is retreated from the folding position. When the blade portion 67*b* is disposed at the retracting position, the blade portion 67*b* faces the movable guide 69, described later, and a retreating path 73 for the sheet S is formed between the movable guide 69 and the blade portion 67*b*.

Figure 6:
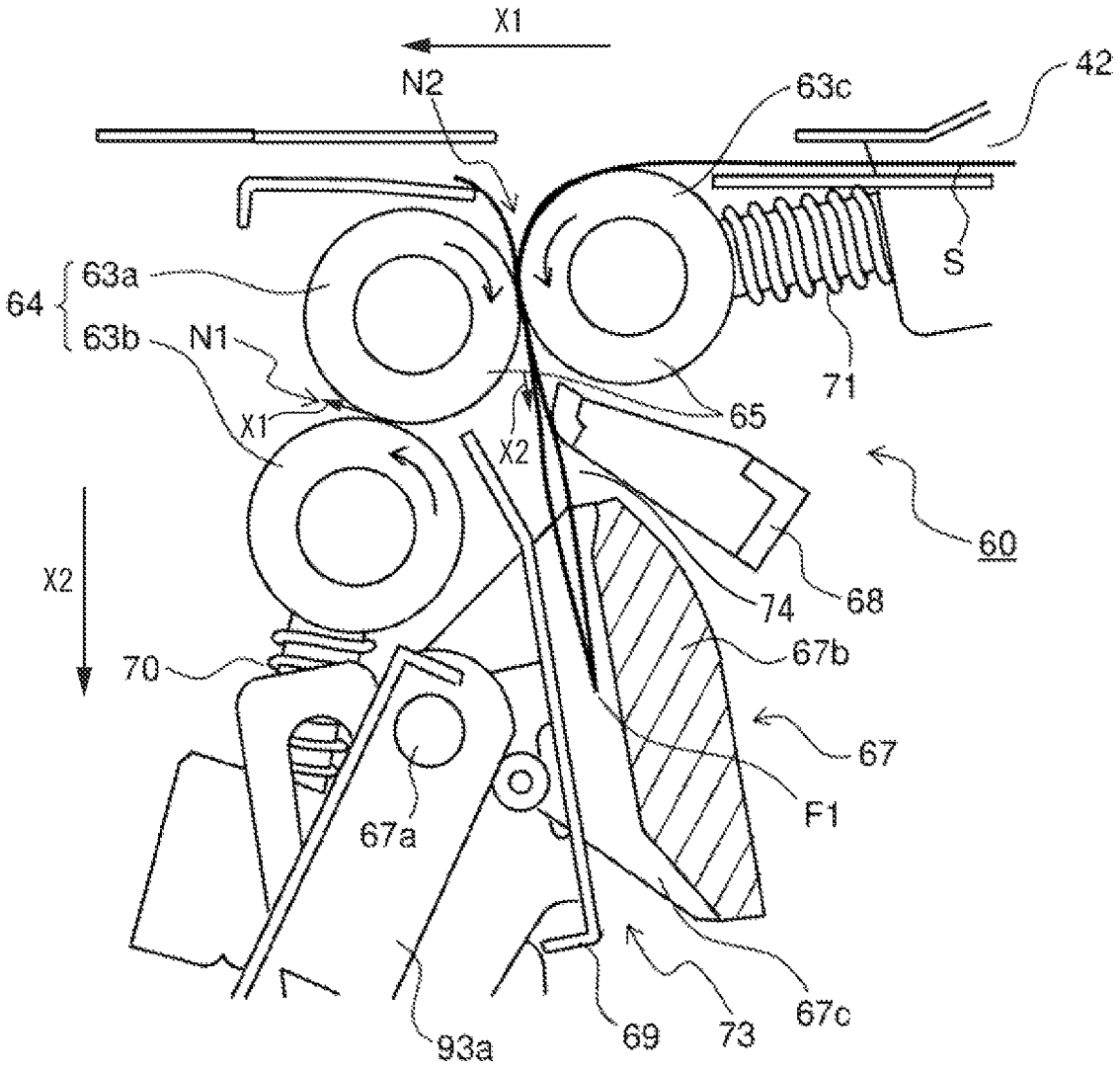
FIG. 6 is a view showing a state where the folding blade 67 is disposed in the retracting position and the movable guide 69 is disposed in the covering position when a sheet S is folded in three by the first sheet folding unit 60.
Figure 7:
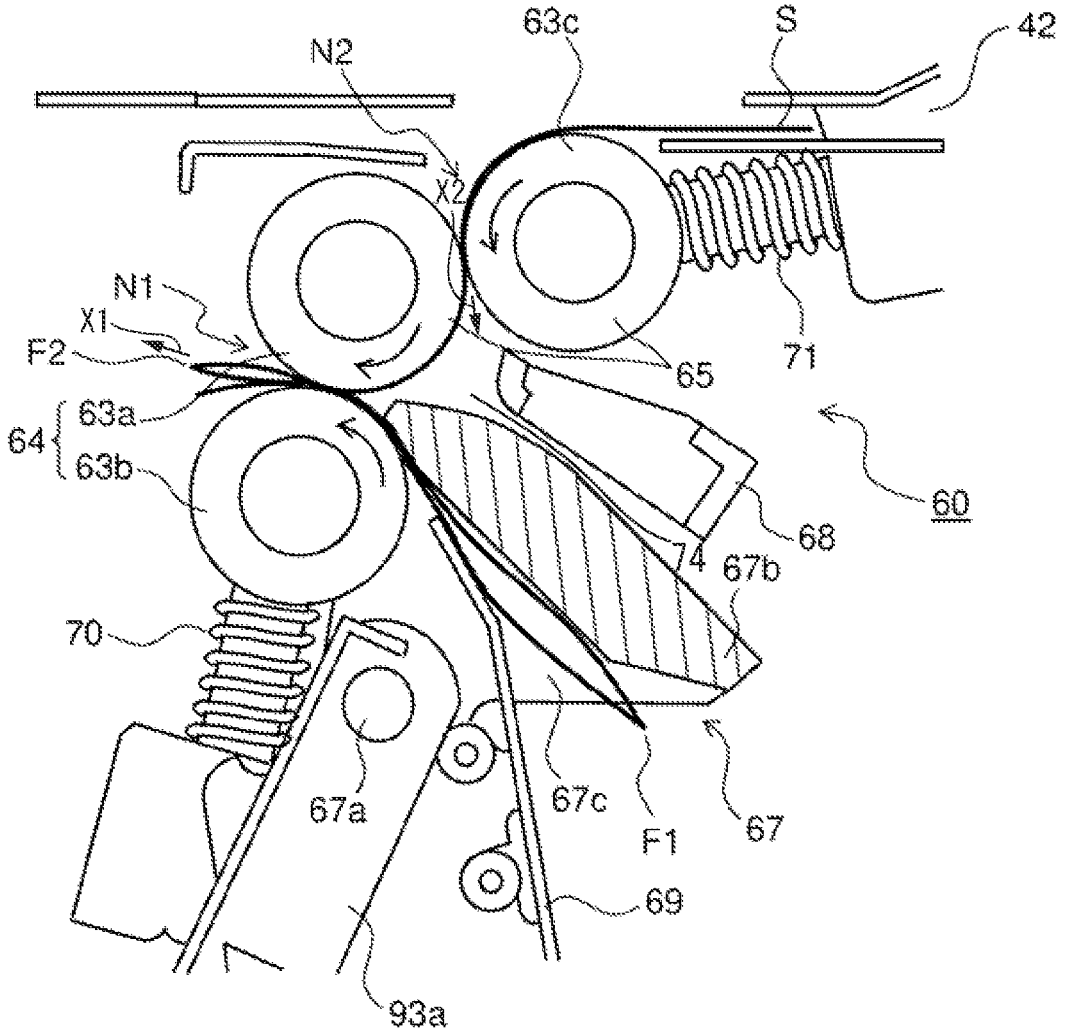
FIG. 7 is a view showing a state where the folding blade 67 is disposed in the folding position and the movable guide 69 is disposed in the non-covering position when a sheet S is folded in three by the first sheet folding unit 60.

The fixed guide 68 and the movable guide 69 are disposed on the conveyance path 74 for the sheet S passed the second nip area N2 on the upstream side of the folding rollers pair 64 in the first direction X1, and guides the sheet S passed through the second nip area N2. The fixed guide 68 is fixed between the first conveyance rollers pair 65 and the folding blade 67. The movable guide 69 is disposed between the pivot shaft 67*a* and the blade portion 67*b* of the folding blade 67, and forms the retreating path 73 together with the inner surface of the blade portion 67*b*. The movable guide 69 can reciprocate between a covering position (see FIG. 4) where the movable guide 69 covers the outer circumferential surface of the second roller 63*b* and the first nip area N1 and a non-covering position (see FIG. 5) where the movable guide 69 is shifted from the covering position and exposes the outer circumferential surface of the second roller 63*b* and the first nip area N1. The movable guide 69 can be shifted between the arm portions 67*c* when it is shifted between the folding position and the retracting position, Next, with reference to FIG. 4 and FIG. 5 to FIG. 7, the folding processing (operation) of the sheet S by the first sheet folding unit 60 will be described. The folding processing of the sheet S is performed by the post-processing controller 101 (see FIG. 3) provided in the sheet post-processing apparatus 30 when a folding mode is selected by the user using an operation panel 12 (see FIG. 2) of the image forming apparatus 10. In FIG. 5 to FIG. 7, the fourth roller 63*d* and the switching guide 72 are not shown.

First, a case where the sheet S is folded in two will be described. As shown in FIG. 4, the conveyance direction of the sheet S received from the first conveyance path 42 is switched into the lower direction by the switching guide 72. Then, the sheet S is conveyed along the outer circumferential surface of the third roller 63*c*, is passed through the second nip area N2 of the first conveyance rollers pair 65, is conveyed in the conveyance path 74, is passed between the fixed guide 68 and the movable guide 69, and then enters the retreating path 73. Then, the conveyance of the sheet S is stopped such that a portion to be folded (a center portion of the sheet in the conveyance direction) faces the first nip area N1.

A timing when the conveyance of the sheet S is stopped is determined based on a detection timing of a sheet detection sensor 75 (see FIG. 3). Specifically, when the sheet detection sensor 75 detects the leading edge of the sheet S, the detection result is transmitted to the post-processing controller 101. The post-processing controller 101 stops the conveyance of the sheet S after a predetermined period elapses from the detection of the leading edge of the sheet S. The period from the detection of the leading edge of the sheet S to the stop of the conveyance of the sheet S is preset for size of the sheet S.

Next, as shown in FIG. 5, the movable guide 69 is shifted to the non-covering position, and the folding blade 67 is turned in the counterclockwise direction and shifted to the folding position. At this time, the blade portion 67*b* of the folding blade 67 comes into contact with the sheet S at the portion to be folded. The sheet S pushed out by the blade portion 67*b* is pushed into the first nip area N1 of the folding rollers pair 64 with a bent state. The fold line F is formed on the sheet S passed through the first nip area N1.

The sheet S formed with the fold line F is conveyed on the second conveyance path 43, and then discharged through the sub discharge port 39 (the sub discharge rollers pair 48) on the sub discharge tray 40. Thereafter, the movable guide 69 is shifted to the covering position and the folding blade 67 is shifted to the retracting position, that is, they are returned to the state shown in FIG. 4 again. After that, the processing for folding the sheet S in two is performed in the same manner.

Next, a case where the sheet S is folded in three (a Z-shaped folding) will be described. In the processing for folding the sheet S in three, first, the switching guide 72 (see FIG. 4) is retracted upward, and the leading edge of the sheet S conveyed along the first conveyance path 42 is stopped on the downstream side (the left side in FIG. 6) of the second nip area N2 such that the first portion to be folded (the portion apart from the leading edge of the sheet S by ⅓ of the length of the sheet S) faces the second nip area N2. A timing when the conveyance of the sheet S is stopped is determined based on a detection timing of a sheet detection sensor (not shown) disposed on the first conveyance path 42.

Next, the switching guide 72 is shifted downward. At this time, the switching guide 72 comes into contact with the sheet S at the first portion to be folded. The sheet S pushed out by the switching guide 72 is pushed into the second nip area N2 of the first conveyance rollers pair 65 in a bent state as shown in FIG. 6. On the sheet S passed through the second nip area N2, the first fold line F1 is formed. The first conveyance rollers pair 65 functions as a folding rollers pair when the sheet S is folded in three.

Thereafter, the sheet S is passed through the second nip area N2 with the first fold line F1 forward, is conveyed in the conveyance path 74, is passed between the fixed guide 68 and the movable guide 69, and then enters the retreating path 73. Then, the conveyance of the sheet S is stopped such that the second portion to be folded (the portion apart from the leading edge of the sheet S by ⅔ of the length of the sheet S) faces the first nip area N1. A timing when the conveyance of the sheet S is stopped is determined based on the detection timing of the sheet detection sensor 75.

Next, as shown in FIG. 7, the movable guide 69 is shifted to the non-covering position, and the folding blade 67 is turned in the counterclockwise direction and shifted to the folding position. At this time, the blade portion 67*b* of the folding blade 67 comes into contact with the sheet S at the second portion to be folded. The sheet S pushed out by the blade portion 67*b* is pushed into the first nip area N1 of the folding rollers pair 64 together with the leading edge of the sheet S and the bent portion of the sheet S. On the sheet S passed through the first nip area N1, the second fold line F2 is formed.

The sheet S formed with the first fold line F1 and the second fold line F2 is conveyed along the second conveyance path 43 and then discharged through the sub discharge port 39 (the sub discharge rollers pair 48) on the sub discharge tray 40. Thereafter, the movable guide 69 is shifted to the covering position and the folding blade 67 is shifted to the retracting position, and the switching guide 72 is retreated upward. After that, the processing for folding the sheet S in three is performed in the same manner.

Figure 8:
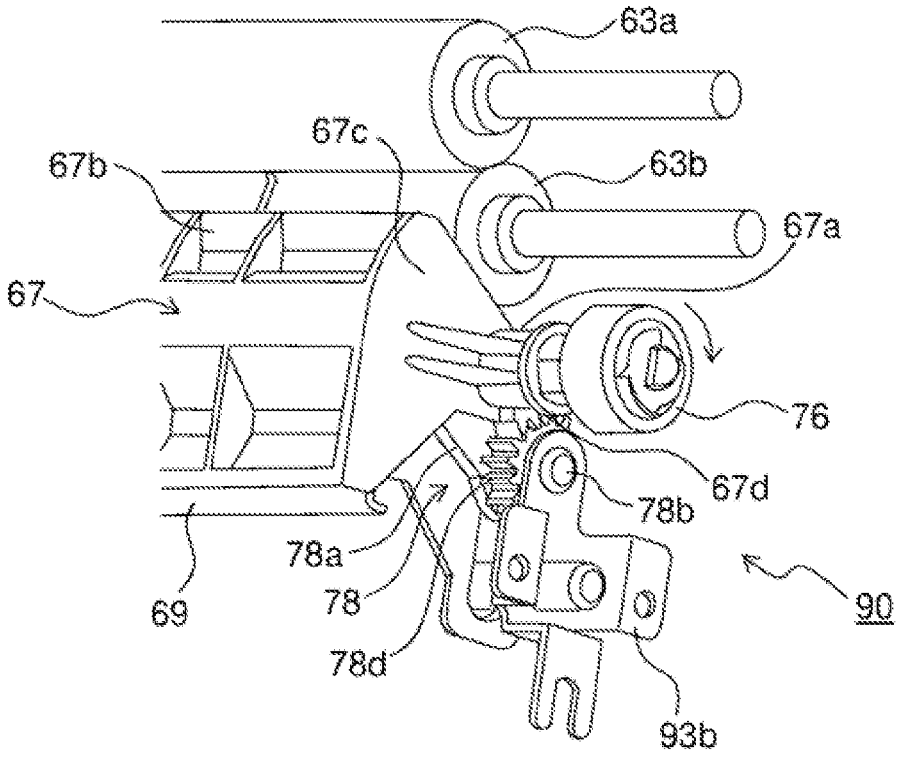
FIG. 8 is a perspective view showing a drive mechanism 90 for the folding blade 67 and the movable guide 69 of the first sheet folding unit 60 of the present embodiment in a state where the folding blade 67 is disposed in the retracting position and the movable guide 69 is disposed in the covering position.
Figure 9:
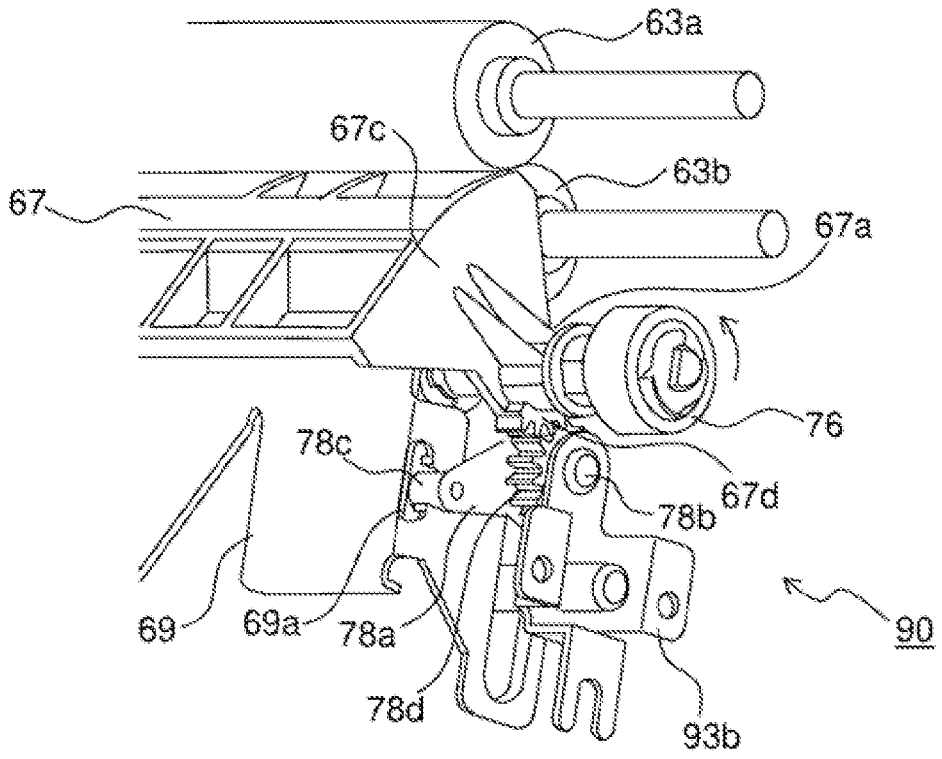
FIG. 9 is a perspective view showing the drive mechanism 90 for the folding blade 67 and the movable guide 69 of the first sheet folding unit 60 of the present embodiment in a state where the folding blade 67 is disposed in the folding position and the movable guide 69 is disposed in the non-covering position.

FIG. 8 and FIG. 9 are perspective views showing a drive mechanism 90 (a drive part) for the folding blade 67 and the movable guide 69 of the first sheet folding unit 60 of the present embodiment. FIG. 8 shows a state where the folding blade 67 is disposed in the retracting position and the movable guide 69 is disposed in the covering position. FIG. 9 shows a state where the folding blade 67 is disposed in the folding position and the movable guide 69 is disposed in the non-covering position. FIG. 8 and FIG. 9 show a configuration of one end sides (the back side on the paper plane on which FIG. 8 and FIG. 9 are drawn) of the folding blade 67 and the movable guide 69, and the other end sides of them have the same configuration other than that a drive input gear 76 is not provided.

The drive mechanism 90 includes the drive input gear 76, a first gear 67*c*, a link member 78 and a drive motor 91 (see FIG. 3). The drive input gear 76 is fixed to the pivot shaft 67*a* of the folding blade 67, and inputs a drive force of the drive motor 91 to the pivot shaft 67*a*. The first gear 67*c* is formed on the outer circumferential surface of the pivot shaft 67*a* partially along the circumferential direction in an arc shape.

The link member 78 has a base part 78*a*, a rotational shaft 78*b* formed on one end portion of the base part 78*a*, an engagement boss 78*c* formed on the other end portion of the base part 78*a*, and a second gear 78*d* formed on the outer circumferential surface of the rotational shaft 78*b*. The link member 78 is supported to the second frame 93*b* by the rotational shaft 78*b* in a rotatable manner. The engagement boss 78*c* is engaged with the engaged portion 69*a* of the movable guide 69. The second gear 78*d* is meshed with the first gear 67*c*.

When the drive input gear 76 is rotated by a predetermined angle in the clockwise direction (a forward direction) from a state shown in FIG. 8 by the drive motor 91, the folding blade 67 is turned by the predetermined angle in the clockwise direction (a forward direction) in FIG. 8 together with the pivot shaft 67*a*, and is disposed in the folding position shown in FIG. 9.

In addition, the first gear 67*c* formed on the pivot shaft 67*a* is rotated in the clockwise direction, and the second gear 78*d* meshed with the first gear 67*c* is rotated in the counterclockwise direction. Thus, the link member 78 is rotated in the counterclockwise direction around the rotational shaft 78*b*, and the movable guide 69 engaged with the link member 78 is shifted downward to be disposed in the non-covering position shown in FIG. 9.

On the other hand, when the drive input gear 76 is rotated by a predetermined angle in the counterclockwise direction (a reverse direction) from a state shown in FIG. 9, the folding blade 67 is turned by the predetermined angle in the counterclockwise direction (a reverse direction) in FIG. 8 together with the pivot shaft 67*a*, and is disposed in the retracting position shown in FIG. 8.

In addition, the first gear 67*c* formed on the pivot shaft 67*a* is rotated in the counterclockwise direction, and the second gear 78*d* meshed with the first gear 67*c* is rotated in the clockwise direction. Thus, the link member 78 is rotated in the clockwise direction around the rotational shaft 78*b*, the movable guide 69 engaged with the link member 78 is shifted upward to be disposed in the covering position shown in FIG. 8.

According to the configuration of the present embodiment, the pivot shaft 67*a* of the folding blade 67 is disposed on the same side as the folding rollers pair 64 with respect to the sheet S to be folded (the conveyance path 74). In other words, the sheet which passes through the second nip area N2, is conveyed to the conveyance path 74 and is to be folded by the folding roller pair 64 stops at a position facing the folding rollers pair 64, and the pivot shaft 67*a* is disposed on the same side as the folding rollers pair 64 with respect to the sheet S. Then, when the sheet S is pushed into the first nip area N1 by the blade portion 67*b*, it becomes possible to make the moving locus of the blade portion 67*b* substantially perpendicular to the sheet S, so that the sheet S can be pushed into the first nip area N1 with higher accuracy.

In addition, when the folding blade 67 is disposed in the retracting position, the retreating path 73 is formed between the pivot shaft 67*a* and the blade portion 67*b* of the folding blade 67. Then, even if the pivot shaft 67*a* and the blade portion 67*b* of the folding blade 67 are disposed on opposite sides to each other with respect to the sheet S, it becomes possible to ensure the retreating path 73 of the sheet S, so that a degree of freedom in arrangement of the folding blade 67 can be enhanced.

In the present embodiment, the movable guide 69 movable between the covering position where it covers the outer circumferential surface of the second roller 63*b* of the folding rollers pair 64 and the non-covering position where it exposes the outer circumferential surface of the second roller 63*b* is provided. Thus, when the sheet S enters the retreating path 73 before the folding processing, the movable guide 69 is disposed in the covering position, so that the sheet S is prevented from coming into contact with the second roller 63*b* of the folding rollers pair 64 rotating in a reverse direction to the conveyance direction, and it becomes possible to prevent the jamming of the sheet S and the edge folding of the sheet S. Then, when the folding processing is performed, the movable guide 69 is disposed in the non-covering position, so that the sheet S can be pushed into the first nip area N1 smoothly by the folding blade 67.

In addition, by driving the folding blade 67 and the movable guide 69 using the drive mechanism 90 including one drive motor 91, the movable guide 69 is shifted to the non-covering position with the movement of the folding blade 67 to the folding position, and the movable guide 69 is moved to the covering position with the movement of the folding blade 67 to the retracting position. Therefore, it is not necessary to synchronize the movement timing of the folding blade 67 with the movement timing of the movable guide 69, and the control mechanism by the post-processing controller 101 can be made simple. In addition, the number of motors can be reduced, thereby contributing to cost reduction.

Further, the first roller 63*a* constitutes the folding rollers pair 64 together with the second roller 63*b*, and constitutes the first conveyance rollers pair 65 together with the third roller 63*c*, so that the first rollers 63*a* also serve as the folding rollers pair 64 and the first conveyance rollers pair 65. Thus, the number of rollers and the arrangement space can be reduced.

Figure 10:
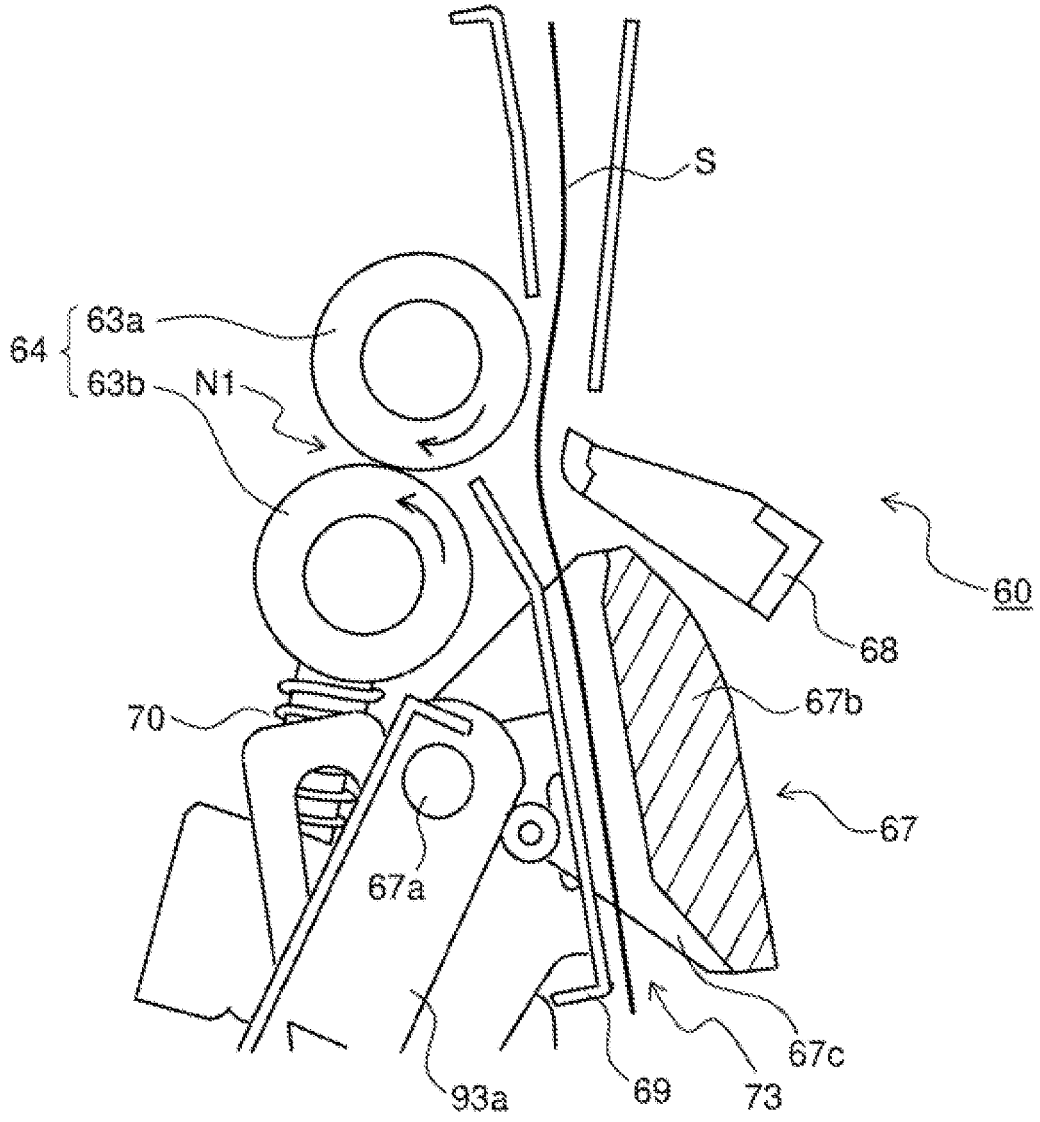
FIG. 10 is a sectional view showing the first sheet folding unit 60 of a modified example of the present embodiment.

In addition, the present disclosure is not limited to the above embodiments, and various modifications can be made without departing from the spirit of the present disclosure. For example, in the embodiment described above, the first sheet folding unit 60 includes the folding rollers pair 64 and the first conveyance rollers pair 65 each consisting of two of the three rollers of the first roller 63*a* to the third roller 63*c*, but the present disclosure is not limited thereto, and for example, as shown in FIG. 10, the first sheet folding unit 60 may include only the folding rollers pair 64 consisting of the first roller 63*a* and the second roller 63*b*. In this case, the sheet S is conveyed from a conveying rollers pair (not shown) upstream of the first sheet folding unit 60.

In the above embodiment, the first gear 67*c* is formed on the pivot shaft 67*a* of the folding blade 67, and the second gear 78*d* is formed on the rotational shaft 78*b* of the link member 78 to directly connect the folding blade 67 and the link member 78, but one or more gears may be disposed between the folding blade 67 and the link member 78 and connect them.

Further, in the above embodiment, the multifunctional peripheral as shown in FIG. 2 is shown as an example of the image forming apparatus 10, but the sheet post-processing apparatus 30 of the present disclosure can be similarly connected to the image forming apparatus other than the digital multifunctional peripheral, such as a laser printer, an ink jet printer, and a facsimile apparatus.

The invention claimed is:

1. A sheet folding device comprising:

a folding rollers pair configured to cause a sheet conveyed along a sheet conveyance path extending in a first conveyance direction to pass through a first nip area to fold the sheet in two and to convey the sheet in a first direction crossing to the first conveyance direction;

a folding blade that extends in an axial direction of the folding rollers pair, is disposed facing the folding rollers pair, and is configured to push a folded portion of the sheet into the first nip area; and a sheet guide extending in the axial direction on an upstream side of the folding rollers pair in the first direction, wherein the folding blade includes:

a pivot shaft provided parallel to the axial direction;

a blade portion pivotable around the pivot shaft, and selectively disposed in a folding position where the blade portion pushes the folded portion of the sheet into the first nip area and in a retracting position where the blade portion is retracted from the folding position to an opposite side to the folding rollers pair with respect to the sheet conveyance path; and a pair of arm portions coupling both end portions of the blade portion in the axial direction with the pivot shaft, wherein the sheet guide can be passed between the pair of arm portions, the blade portion faces the sheet guide in a state of being disposed in the retracting position, and forms, between the blade portion and the sheet guide, a retreating path in which a part of the sheet is retreated when the folded portion is pushed into the first nip area, the folding rollers pair includes a first roller and a second roller disposed on a downstream side of the first roller in the first conveyance direction and brought into pressure contact with the first roller, and the sheet guide can reciprocate between a covering position where the sheet guide covers an outer circumferential surface of the second roller and the first nip area and a non-covering position where the sheet guide exposes the outer circumferential surface of the second roller and the first nip area.

2. The sheet folding device according to claim 1, wherein, the sheet guide is disposed in the non-covering position when the folding blade is disposed in the folding position, and the sheet guide is disposed in the covering position when the folding blade is disposed in the retracting position.

3. The sheet folding device according to claim 2, wherein the sheet guide is disposed between the pivot shaft and the blade portion, and the retreating path is formed between the movable guide and a pivot shaft side surface of the blade portion.

4. The sheet folding device according to claim 1, comprising a drive part which drives the folding blade, wherein the sheet guide is driven by the drive part to be reciprocated between the covering position a and the non-covering position.

5. The sheet folding device according to claim 1, further comprising:

a first conveyance rollers pair including the first roller and a third roller brought into pressure contact with the first roller, and conveying the sheet in the first conveyance direction; and a switching guide disposed on an upstream side of the first rollers pair in the first conveyance direction and capable of guiding the sheet to a second nip area between the first roller and the third roller, wherein when the sheet is guided to the second nip area by the switching guide, the first conveyance rollers pair serves as a folding rollers pair forming a first fold when the sheet is folded in three.

6. The sheet folding device according to claim 5, further comprising a second conveyance rollers pair including the third roller and a fourth roller brought into pressure contact with the third roller, and conveying the sheet not subjected to the folding processing, wherein the fourth roller has a plurality of roller parts divided in an axial direction, and the switching guide is disposed between the plurality of roller parts.

7. The sheet folding device according to claim 5, wherein, the first roller, the second roller and the third roller rotate only in one direction.

8. A sheet post-processing apparatus comprising:

a carry-in port into which a sheet is carried;

the sheet folding apparatus according to claim 1, configured to perform the folding processing on the sheet conveyed from the carry-in port;

a discharge port through which the sheet is discharged; and a discharge tray configured to receive the sheet discharged through the discharge port is stacked.

* * * * *